United States Patent [19]

Bastos et al.

[11] 4,122,568

[45] Oct. 31, 1978

[54] MATTRESS OF THE HARD SURFACE TYPE

[76] Inventors: José R. R. Bastos; Eduardo R. Bastos, both of 16 Aurelino Leal St., Rio de Janeiro, Brazil

[21] Appl. No.: 805,469

[22] Filed: Jun. 10, 1977

[51] Int. Cl.[2] ..... A47C 27/04

[52] U.S. Cl. ..... 5/345 R; 5/353; 5/91

[58] Field of Search ..... 297/DIG. 8; 5/351, 345, 5/91, 353, 352, 12

[56] References Cited

U.S. PATENT DOCUMENTS

| | | | |
|---|---|---|---|
| 3,276,048 | 10/1966 | Beckman | 297/DIG. 8 |
| 3,467,972 | 9/1969 | Bastos et al. | 5/351 |
| 3,546,724 | 7/1968 | Bastos et al. | 5/351 |
| 3,551,924 | 5/1969 | Frye | 5/351 |
| 3,720,966 | 3/1973 | Zysman | 5/351 |

FOREIGN PATENT DOCUMENTS

| | | | |
|---|---|---|---|
| 914,505 | 10/1946 | France | 297/DIG. 8 |
| 1,321,826 | 7/1973 | United Kingdom | 5/351 |

*Primary Examiner*—Mervin Stein
*Assistant Examiner*—Victor N. Sakran
*Attorney, Agent, or Firm*—Emory L. Groff, Jr.

[57] ABSTRACT

An orthopedic mattress is made of a plurality of rigid supporting members each including a vertical post with a rigid flat platform at its upper and lower ends. The platforms are preferably square in shape and may include connecting means on each of the side edges thereof. The supporting members are arranged in longitudinal and transverse rows and the entire assembly is covered with a soft material such as foam rubber.

5 Claims, 8 Drawing Figures

MATTRESS OF THE HARD SURFACE TYPE

This invention relates to an improvement in mattresses of the hard-surface type, which are also known as ortho-pedic mattresses, since they do not sink under the weight of a human body at rest.

The invention specifically relates to an improvement over U.S. Pat. No. 3,546,724 in which is disclosed a structure comprising a plurality of vertically rigid bar-like supporting members fixed, in an articulated manner at their ends to the internal opposite faces of two deflectible thin plates, such plates being covered by one or more layers of a soft material such as foam rubber or otherwise, forming the upper and lower surfaces of the mattress.

As already mentioned in the previous patent, due to the articulated connection of the ends of the rigid supporting members at the internal faces of said plates, together with the relative deflection of the plates themselves, the invention offers the main advantage of combining in a hard-surface mattress two traditionally opposite attributes, such as: (a) the non-sinking of its surfaces under the weight of a human body at rest and (b) a relative structural connection, thus allowing the lifting of the sides and corners of the mattress to put under them the marginal edges of sheets during the daily household work of making beds.

However, as shown in actual usage, such connection, essential to the mattress performance, remains much too restricted, due to the small bending capacity of such plates, preferably which are made of plywood. Furthermore, the non-elastic characteristic of such plates remaining in a non-bending position requires a certain lifting effort which, although not very important in itself, represents however a hindrance to the daily work of making beds.

In addition, such plates, due to the increasing cost of plywood, has become a serious factor in increasing prices for said mattresses, specially in plywood importing countries. Metal and plastic plates are even more expensive, representing no advantageous alternatives.

A structure without such plates has already been the subject of U.S. Pat. No. 3,467,972, comprising a plurality of non-deformable blocks. Due to its high cost and complexity of manufacture has not been feasible from the standpoint of marketability.

The present invention, having in view the above mentioned problems, relates to an improvement over U.S. Pat. No. 3,546,724. The primary object and main advantage of the present invention is to allow the omission of said plates, replacing them by a core structure comprising the same vertical rigid supporting members but provided at each end thereof, with a large flat platform. These platforms may vary in shape and size and or arranged side by side in such way as to form, by means of the upper ones, a continuous surface corresponding to the upper face of the mattress. The lower platforms, arranged in the same way provide the lower face of the mattress. The upper and lower surfaces are covered by one or more layers of a soft material such as foam rubber appropriately fixed to said platforms, in order to encase and draw together as a whole the plurality of rigid supporting members.

The improvement is illustrated by reference to the accompanying drawings, in which.

Figure 1:
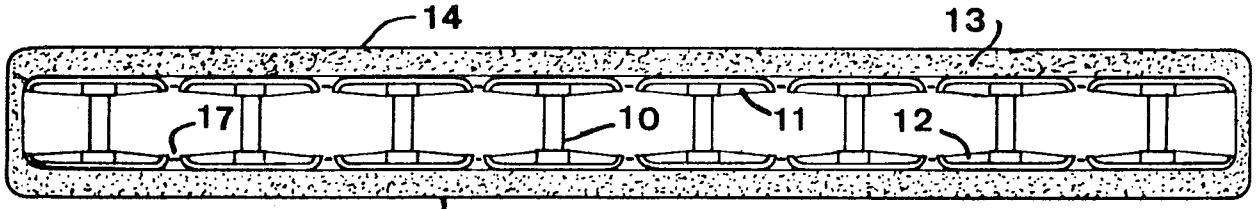
FIG. 1 is a side elevation, partly in section, of a mattress according to the invention in the normal use position.
Figure 2:
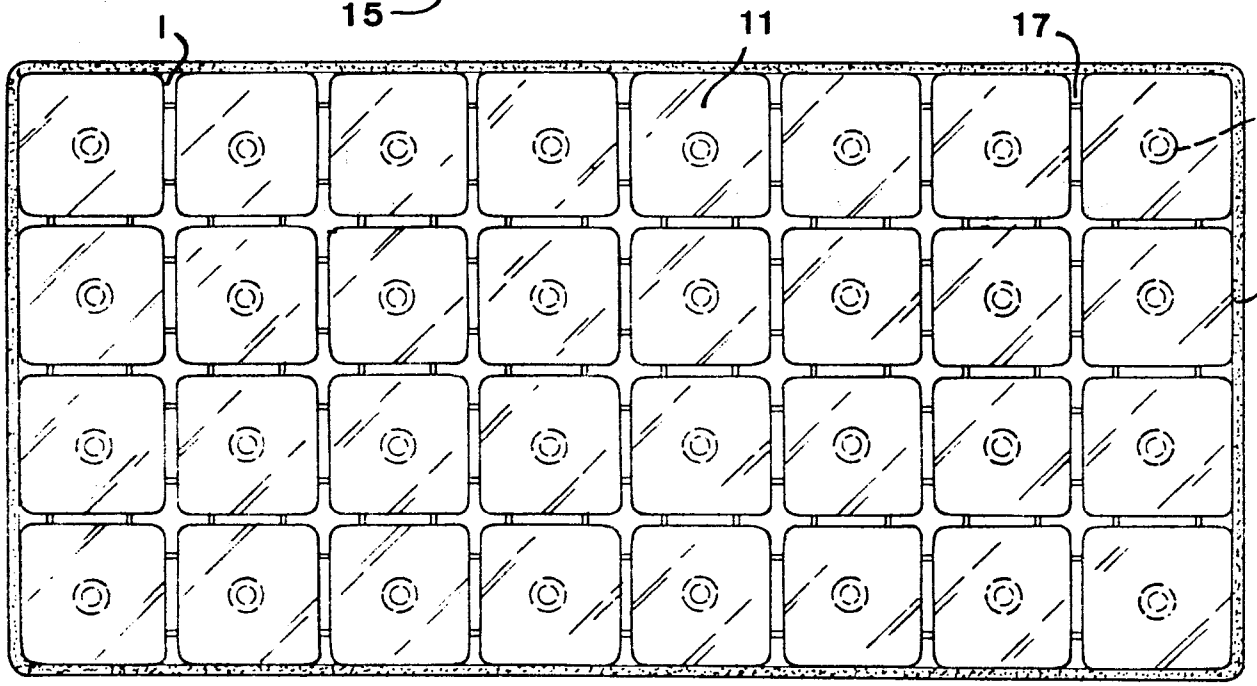
FIG. 2 is a top plan view partly in section, of the mattress shown in FIG. 1 with the top layer of foam rubber removed.

Referring to the drawings in detail, FIG. 1 shows the mattress in the normal use position thereof, with the rigid individual supporting members 10 disposed in their connected assembled position. Supporting members include upper and lower platforms 11 and 12 respectively, which are covered by one or more layers 13 of a soft material, such as foam rubber, thus forming the upper and lower faces 14 and 15 respectively, of the mattress. There is a small space I between adjacent edges of the upper and lower platforms to facilitate their connection to adjacent platforms and the raising of the edges of the mattress.

Figure 4:
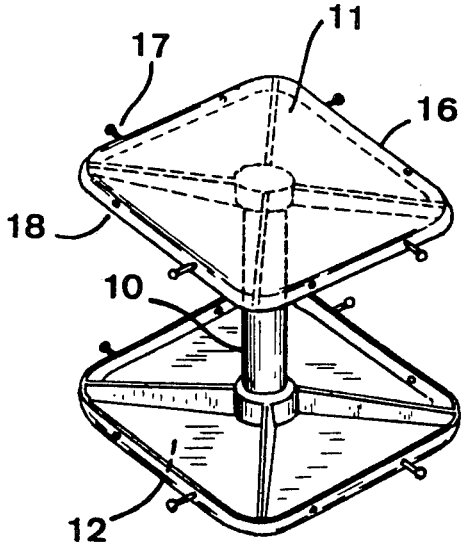
FIG. 4 is a perspective view of one of the supporting members.
Figure 5:
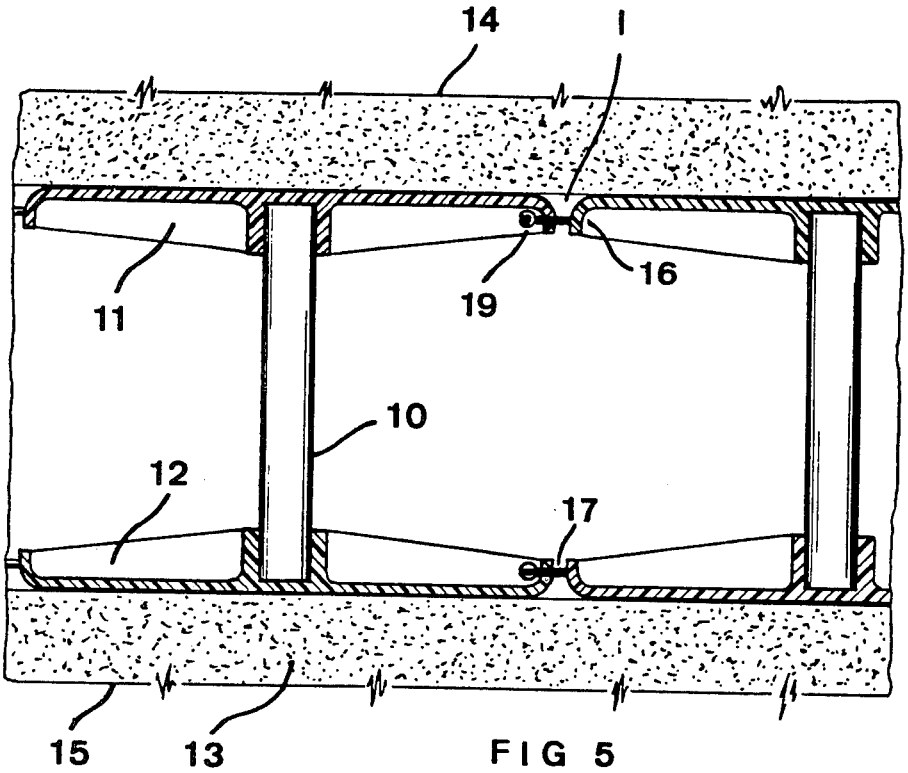
FIG. 5 is an enlarged, fragmentary side elevation, partly in section, of the mattress shown in FIG. 1.
Figure 6:
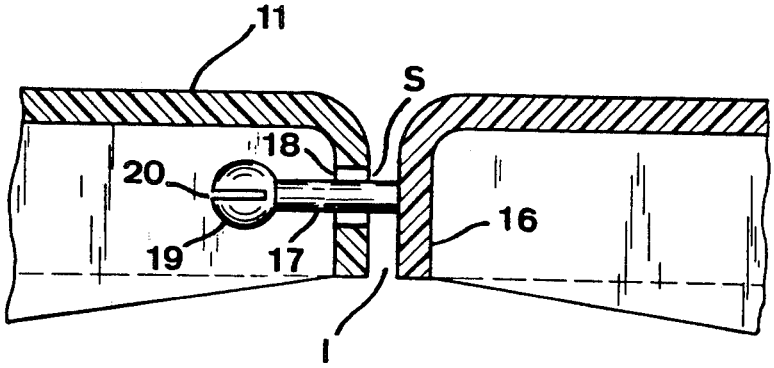
FIG. 6 is an enlarged, fragmentary side elevation partly in section, showing the means for connecting two adjacent supporting members.

Referring to FIG. 4, it will be seen that each of the edges 16 of the platforms 11 and 12 are provided with connection means in the form of pins 17 and holes 18, to allow the side-by-side connection of a plurality of said platforms as shown to an advantage in FIGS. 5 and 6.

As seen particularly in FIG. 6, the pins 17 are provided with enlarged heads 19 which have a longitudinal groove 20 therein so as to permit compression of the heads when they are passed through holes 18 which are of lesser diameter than the diameter of the heads. The holes 18 are of greater diameter however, than the body of the pins 17 which leaves a space S therebetween to permit a more flexible connection between related supporting members.

Figure 7:
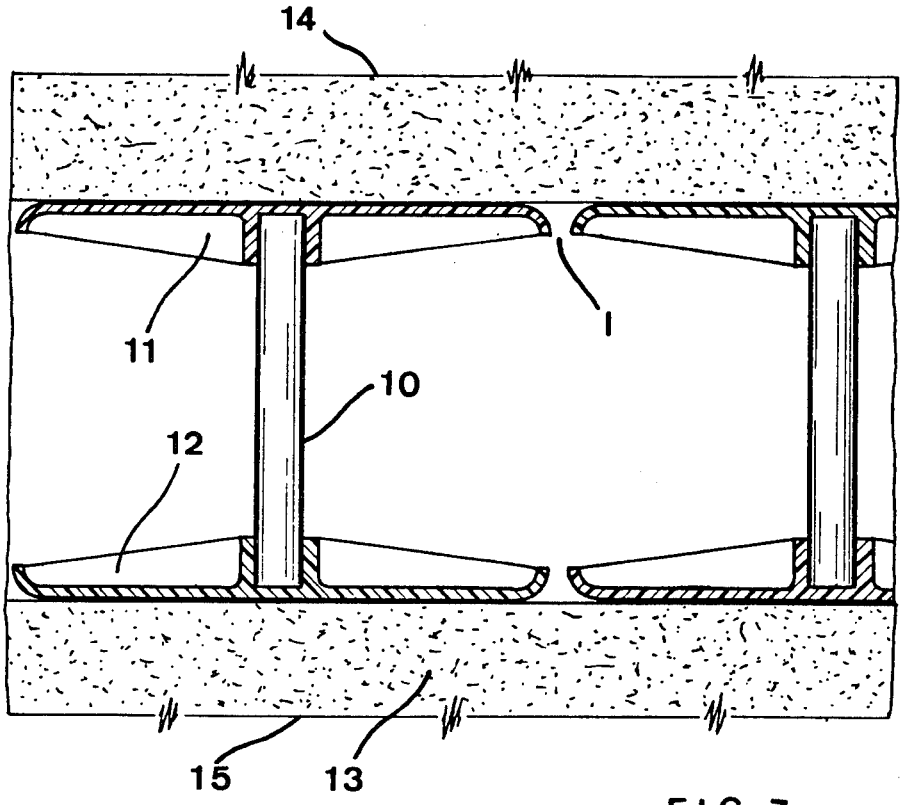
FIGS. 7 and 8 show a modified embodiment of the structures shown in FIGS. 4 and 5 respectively.
Figure 8:
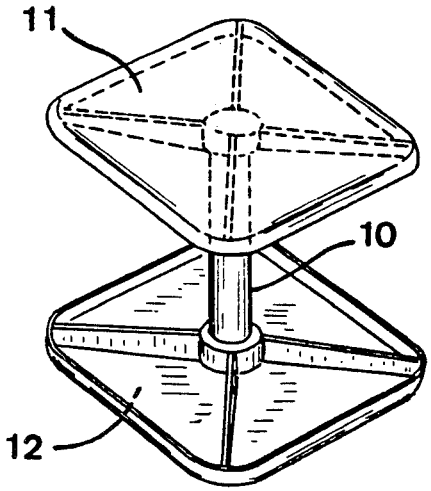

FIGS. 7 and 8 show a modification wherein said rigid supporting members 10 are constructed without the previously referred to coupling means namely, the pins and related holes on the side edges of the platforms.

As seen from the foregoing description, such platforms comprising the upper and lower faces of the mattress, advantageously permit the exclusion of the plates disclosed in U.S. Pat. No. 3,546,724 thus providing a more flexible connecting means between the upper and lower surfaces of the mattress without sacrificing the orthopedic function thereof.

This improvement, besides making the structure lighter and the manufacture thereof simpler, brings the additional benefit of removing also the small spiral draw springs or other fastening means provided for in said U.S. Pat. No. 3,546,724, in order to prevent the mutual disconnection of the plates under deflection of the mattress structure.

Figure 3:
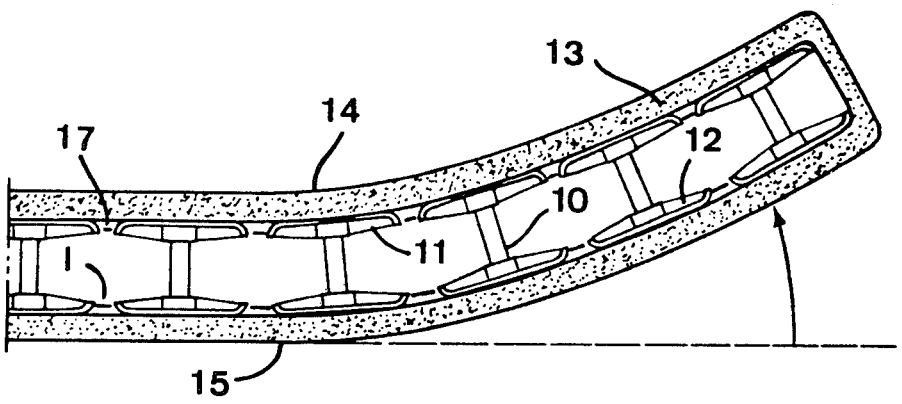
FIG. 3 is a partial side elevation of the mattress shown in FIG. 1 showing a portion of the mattress raised as would occur when making a bed and placing the bed linen under the edges of the mattress.

In accordance with the improvement, of the present invention, the movement of the structure depends now only on the natural and limited flexibility of the layer or layers 13 of soft material along the intervals I between the platforms, allowing an easier lifting of the structure as seen in FIG. 3.

The drawings illustrate, in a non-restrictive way, a preferred construction of the invention, which can vary not only in relation to the rigid supporting members themselves, such as poles, posts or any other vertical-shaped construction, but also in relation to said platforms, which can be moulded as an integral body with the rigid vertical supporting members themselves, or be mounted therein by means of a coupling or otherwise.

Furthermore, other forms of coupling means can be used at the edges 16 of said platforms, if capable of allowing a proper connection thereof in order to permit structural deflection when the sides and corners of the mattress are lifted.

Having thus described this improvement, we claim:

1. A mattress of the hard-surface type comprising a plurality of vertical rigid supporting members, each supporting member including a vertically disposed post and a rigid, flat platform at the upper and lower ends of said posts, said supporting members arranged side-by-side in a plurality of longitudinal and in transverse rows, the edges of the upper and lower platforms disposed adjacent related edges of other platforms in said longitudinal and transverse rows and spaced from said adjacent edges to provide flexability for said mattress, said upper and lower platforms forming the upper and lower planar surfaces of said mattress, including connecting means comprises at least one pin an at least one opening on each edge of said upper and lower platforms whereby the pins of one platform engages in a related opening of an adjacent platform.

2. A mattress according to claim 1, wherein said upper and lower planar surfaces are covered by at least one layer of soft material secured to said platforms to encase and draw together said rigid supporting members.

3. A mattress according to claim 1, wherein said connecting means is on said upper and lower platforms.

4. A mattress according to claim 1, wherein each of said pins is provided with a compressible head of greater diameter than the diameter of each of said openings.

5. A mattress according to claim 4, wherein said platforms are integral with said vertical posts.

* * * * *